United States Patent [19]

Wakabayashi et al.

[11] Patent Number: 5,007,889

[45] Date of Patent: Apr. 16, 1991

[54] APPARATUS FOR FEEDING CONTAINER BLANKS TO CONTAINER BOTTOM FORMING MANDREL

[75] Inventors: Shigeru Wakabayashi; Masao Shimokawa; Masaki Takahashi, all of Tokushima, Japan

[73] Assignee: Shikoku Kakoki Co., Ltd., Tokushima, Japan

[21] Appl. No.: 457,651

[22] Filed: Dec. 27, 1989

[30] Foreign Application Priority Data

Dec. 28, 1988 [JP] Japan ..... 63-170924[U]

[51] Int. Cl.[5] ..... B31B 5/06; B31B 3/78

[52] U.S. Cl. ..... 493/316; 493/122; 493/125; 493/164

[58] Field of Search ..... 493/122, 123, 124, 125, 493/126, 127, 133, 164, 307, 313, 316

[56] References Cited

U.S. PATENT DOCUMENTS

| | | | |
|---|---|---|---|
| 2,900,880 | 8/1959 | Engleson et al. | 493/316 |
| 3,364,826 | 1/1968 | Austin et al. | 493/165 |
| 3,486,423 | 12/1969 | Mistarz | 493/181 |
| 4,493,687 | 1/1985 | Bernle | 493/316 |
| 4,579,551 | 4/1986 | Ulrich et al. | 493/316 |
| 4,708,707 | 11/1987 | Koike et al. | 493/313 |

*Primary Examiner*—William E. Terrell

*Attorney, Agent, or Firm*—Armstrong, Nikaido, Marmelstein, Kubovcik, & Murray

[57] ABSTRACT

An apparatus for use with blanks folded to a flat form for unfolding each blank into a tube of rectangular to square cross section and feeding the tubular blank to one of container bottom forming mandrels which is at rest at a feed station. The apparatus comprises a magazine for accommodating a multiplicity of such blanks as arranged side by side, transport arms for delivering the blanks one by one from a delivery opening of the magazine and transporting each blank to a position on an extension of the axis of the mandrel, an unfolding arm for unfolding the blank from the flat form to the tubular form during transport by forming a fold in the opposed flat portions of the blank, a holder for holding the tubular blank on the extension of axis in alignment therewith movably along the extension, and a transfer assembly for transferring the blank from the holder to the mandrel. The forward end of the unfolding arm is movable into and out of the path of transport of the blank. One of adjacent two side wall panels among four side wall panels of the blank is pushed toward the other panel by the arm end advanced into the path to thereby form the fold in each of the opposed flat portions of the blank.

6 Claims, 11 Drawing Sheets

APPARATUS FOR FEEDING CONTAINER BLANKS TO CONTAINER BOTTOM FORMING MANDREL

BACKGROUND OF THE INVENTION

The present invention relates to an apparatus for use with blanks folded to a flat form for unfolding each blank into a tube of rectangular to square cross section and feeding the tubular blank to one of container bottom forming mandrels which is at rest at a feed station.

Conventional apparatus of the type mentioned include those comprising a magazine for accommodating a multiplicity of blanks as arranged side by side, transport means for delivering the blanks from a delivery opening of the magazine one by one and transporting each blank to a position on an extension of the axis of the mandrel, means for unfolding the blank from a flat folded form into a tube of rectangular to square cross section during transport by folding the opposed flat portions of the blank, a holder for holding the tubular blank on the extension of axis of the mandrel in alignment therewith movably along the extension, and a transfer assembly for transferring the blank from the holder to the mandrel. The transport means has a suction member for holding one of the four side wall panels of the blank thereto by suction. The unfolding means has an unfolding member which is fixedly disposed within the path of transport of the blank so as not to interfere with the side wall panel held to the suction member. During transport, another one of the four side wall panels not held by the suction member is brought into contact with the unfolding member and thereby bent, whereby a fold is formed on each of the opposed flat portions of the blank.

With the conventional apparatus described, the unfolding member is fixedly disposed in the path of transport of the blank, so that the opposed flat portions of the blank can not be bent beyond a limit and therefore fail to remain fully bent to form the fold. When the blank is further transported as held in the tubular form by being slidingly moved longitudinally thereof, the force acting to restore the blank to the flat form then acts against the sliding movement. This gives rise to the problem that the blank being transported will not be smoothly transferred from the holder to the mandrel owing to great sliding resistance. Furthermore, where the blank is made into a container, a neat corner will not be formed at the junction of the adjacent two side wall panels, hence another problem of a poor appearance as a commercial product;

SUMMARY OF THE INVENTION

The main object of the present invention is to overcome the above problems and to provide an apparatus for feeding container blanks to a container bottom forming mandrel which apparatus is adapted to form satisfactory folds in the blank so as not to permit the blank to restore itself to a flat form.

The present invention provides an apparatus for feeding container blanks to a container bottom forming mandrel, each of the blanks having first to fourth four side wall panels divided by scores and joined to one another endlessly, the blank being folded to a flat form along the score between the first side wall panel and the second side wall panel and along the score between the third side wall panel and the fourth side wall panel so as to be unfoldable into a tube of rectangular to square cross section, the apparatus being adapted to unfold each blank to the tubular form and feed the tubular blank to the forming mandrel at rest at a feed station. The apparatus comprises a magazine having a delivery opening at one end for accommodating a multiplicity of vertical flat blanks as arranged side by side from said one end toward the other end of the magazine, with the second and third side wall panels directed toward the delivery opening and with the second side wall panel positioned under the third side wall panel, the delivery opening being positioned at one side of an extension of the axis of the mandrel obliquely thereabove; transport means for delivering the blanks from the delivery opening one by one and transporting each blank to a position on the extension of axis of the mandrel, the transport means having a suction member for holding the second side wall panel of the blank thereto by suction, the suction member being attached to the forward ends of transport arms, the transport arms being fixed at their base ends to a first rotatable shaft disposed below the magazine and extending in parallel to the extension of axis of the mandrel; means for unfolding the blank from the flat form to the tubular form by forming a fold in the opposed flat portions of the blank while the blank is being transported by the transport means, a holder for holding the tubular blank on the extension of axis of the mandrel in alignment therewith movably along the extension; and a transfer assembly for transferring the blank from the holder to the mandrel.

The blanks accommodated in the magazine are each delivered from the delivery opening of the magazine by being attracted to the suction member, transported to the holder by the transport arms which are pivotally moved by the rotation of the first rotatable shaft, and held by the holder. The blank is then transferred from the holder to the mandrel by the transfer assembly. The unfolding means forms a fold in each of the opposed flat portions of the blank being transported as held to the suction member so as to open the blank from the flat form to the tubular form.

The unfolding means comprises an unfolding arm fixed at its base portion to a second rotatable shaft extending in parallel to the first rotatable shaft. The second shaft is disposed on opposite side to the first shaft with respect to the path of movement of the second side wall panel of the blank held to the suction member so as to render the forward end of the unfolding arm movable into and out of the path of movement. Accordingly, the blank is effectively prevented from restoring itself to the original flat form by the folds formed in the blank.

DESCRIPTION OF THE PREFERRED EMBODIMENT

An embodiment of the present invention will be described below with reference to the drawings. A) Blank The blank for use with the present apparatus will be described first.

Figure 11:
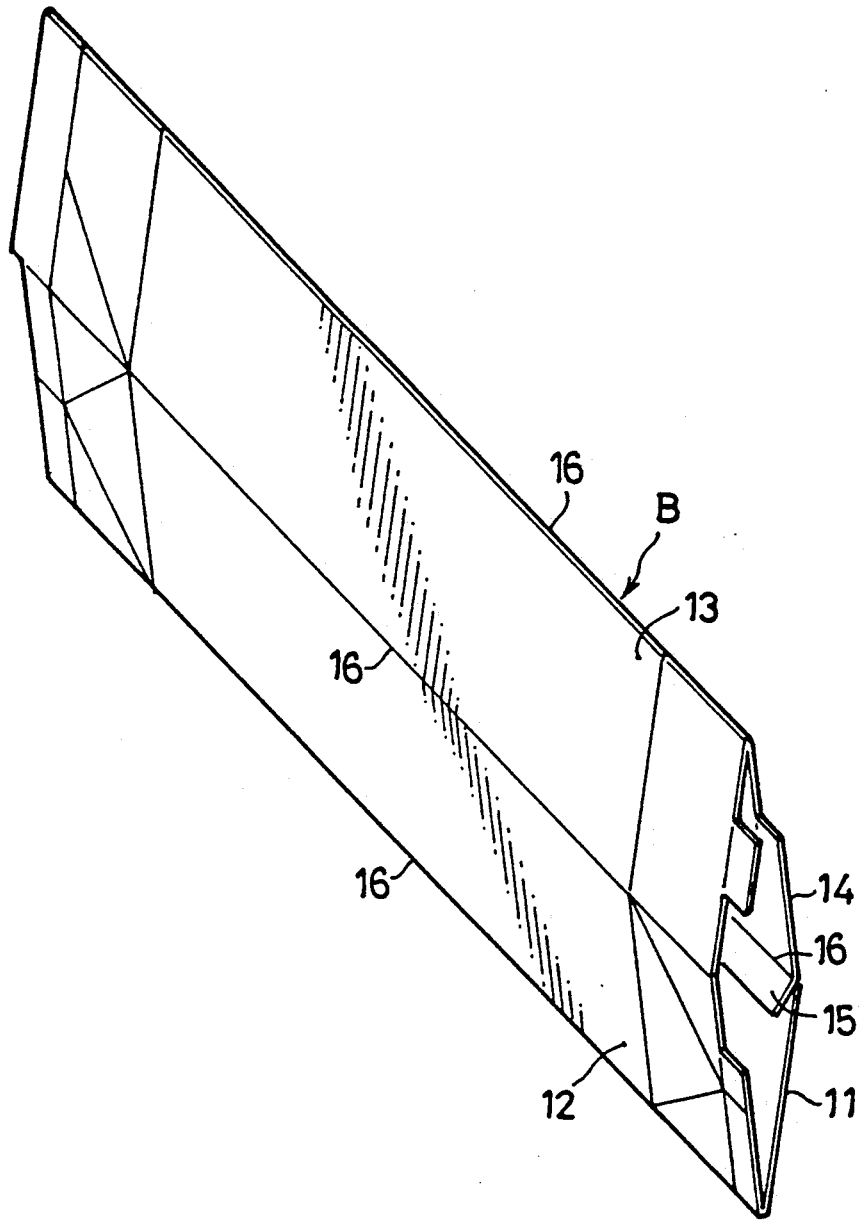
FIG. 11 is a perspective view of a blank.

Although not shown in detail, the blank B as illustrated in FIG. 11 is made of a paper-base laminate including aluminum foil and coated with a thermoplastic synthetic resin over the inner and outer surfaces thereof. The blank B comprises first to fourth four side wall panels 11 to 14 joined to one another endlessly, and a joint panel 15 integral with the free edge of the fourth side wall panel 14. A score 16 is formed at the boundary between each pair of adjacent side wall panels 11 to 14. A score 16 is formed also at the boundary between the fourth side wall panel 14 and the joint panel 15. The joint panel 15 is lapped over and joined to the inner surface of the free edge portion of the first side wall panel 11. The blank B is folded to a flat form along the score 16 between the first panel 11 and the second panel 12 and also along the score 16 between the third panel 13 and the fourth panel 14 so as to be unfoldable into a tube of rectangular to square cross section.

B) Brief Description of Mandrel and Feeding Apparatus

Figure 1:
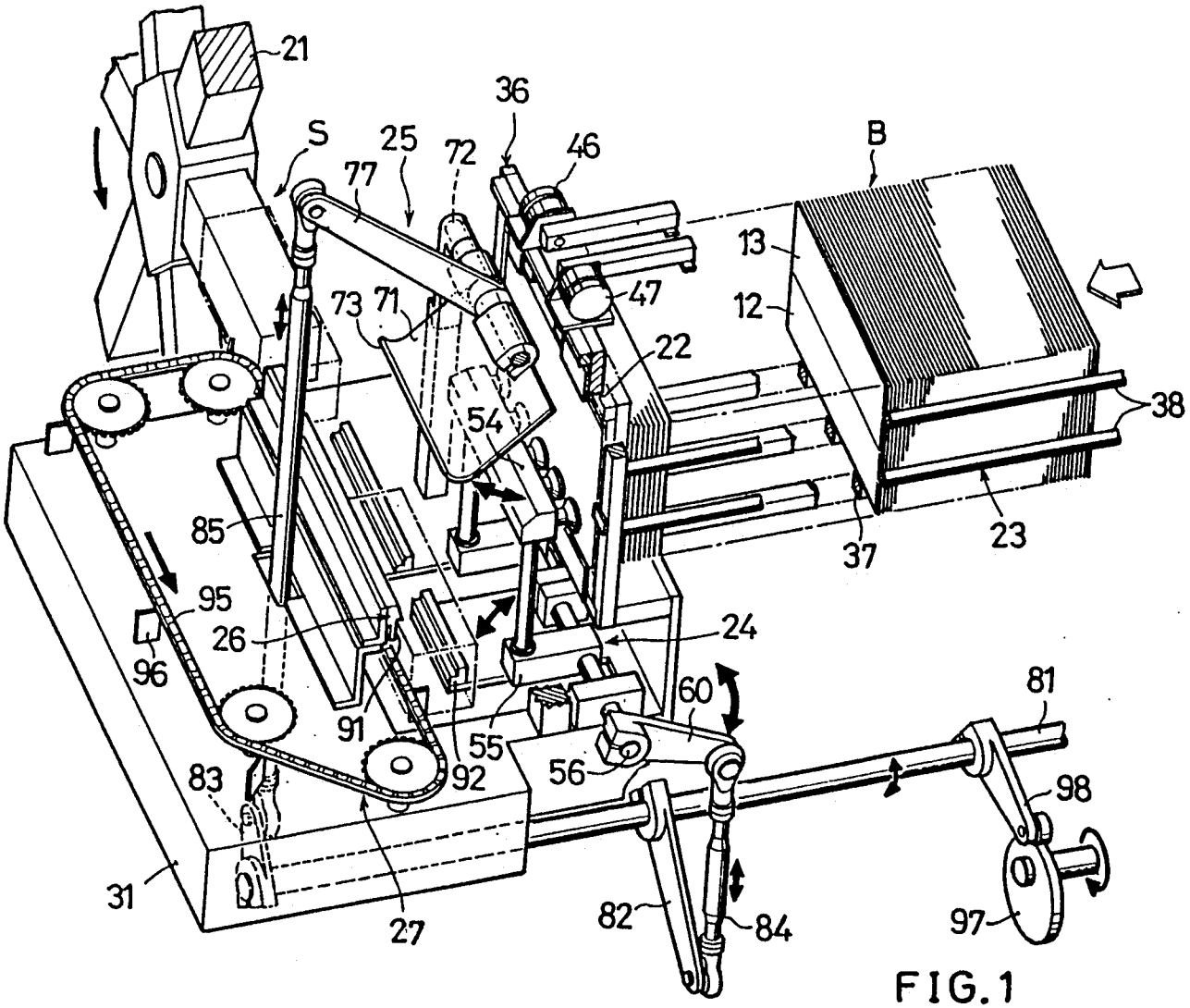
FIG. 1 is an overall perspective view showing an apparatus embodying the present invention.
Figure 3:
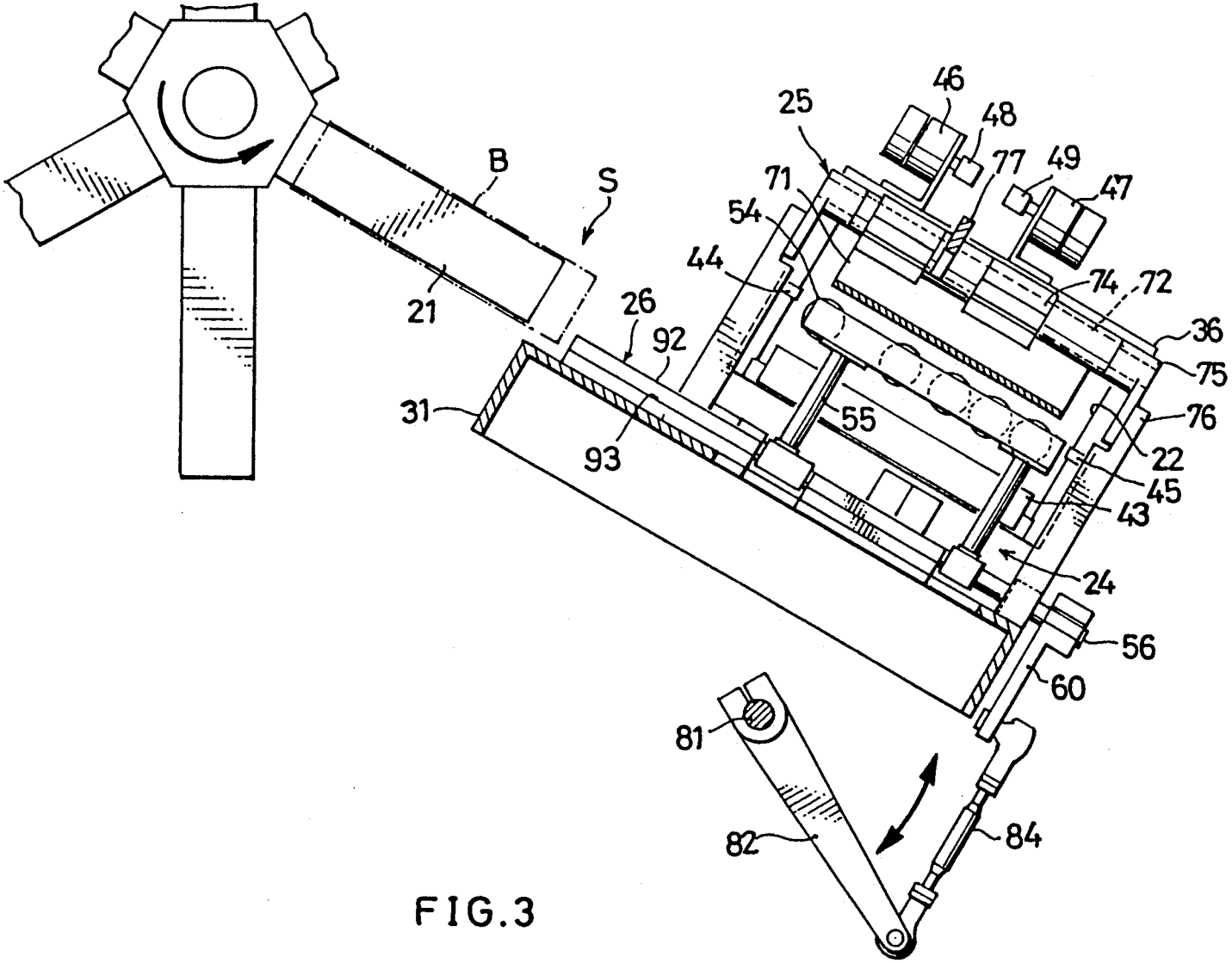
FIG. 3 is a view in cross section taken along the line III—III in FIG. 2 and showing the apparatus in its entirely.

FIGS. 1 and 3 show a container bottom forming mandrel 21 as stopped at a feed station S, and the apparatus for feeding the container blank B to the mandrel 21.

Figure 2:
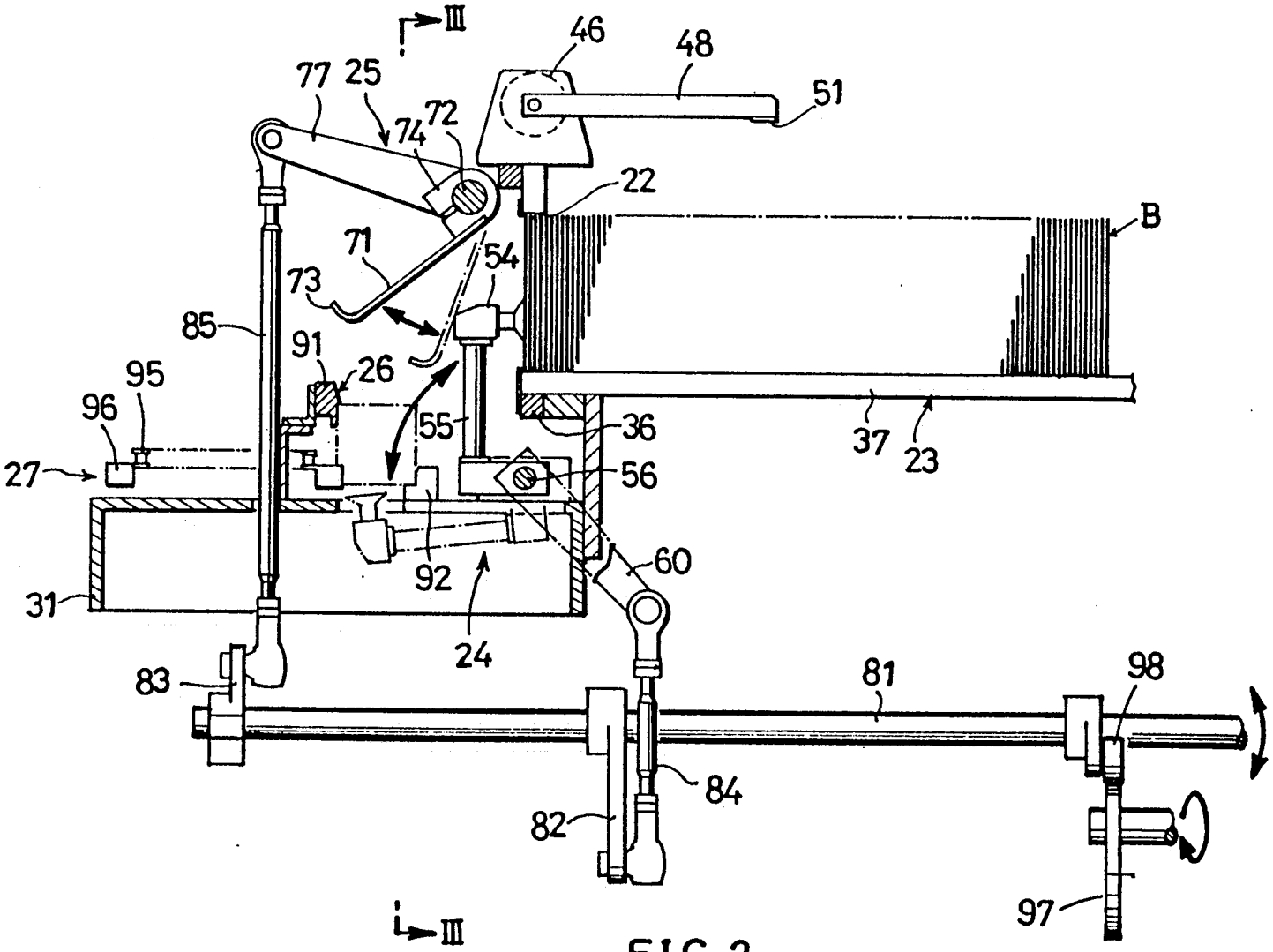
FIG. 2 is a view in vertical section showing the apparatus in its entirety.

In the following description, the terms "front" and "rear" are used based on FIG. 3; the left side of the drawing is referred to as "front," and the right side thereof as "rear." The terms "right" and "left" are used based on FIG. 2; the right side thereof is referred to as "right," and the left side thereof as "left."

Briefly described, a plurality of mandrels 21 extend from an intermittently driven horizontal rotary shaft and are each adapted to successively stop at a plurality of work stations including the feed station S by the rotation of the shaft. When at rest at the feed station S, the mandrel 21 is directed rearward obliquely downward at an angle of about 30 degrees with respect to a horizontal line.

The blank feeding apparatus comprises a magazine 23 having at one end thereof a delivery opening 22 positioned at right side of an extension of the axis of the mandrel 21 obliquely thereabove when the mandrel is at rest at the feed station S, transport means 24 for delivering blanks B from the magazine 23 through the opening 22 one by one and transporting each blank B from the delivered position to a position on the extension of the axis, unfolding means 25 disposed at a position intermediate between the starting end of the path of transport of the blank and the terminal end thereof for unfolding the blank B from the flat form to the tubular form by forming a fold in the opposed two flat portions of the blank B during the transport, a holder 26 disposed at the terminal end of the transport path for holding the tubular blank B on the extension of axis of the mandrel 21 in alignment therewith movably along the extension, and a transfer assembly 27 for transferring the blank B from the holder 26 to the mandrel 21.

C) Magazine

Figure 4:
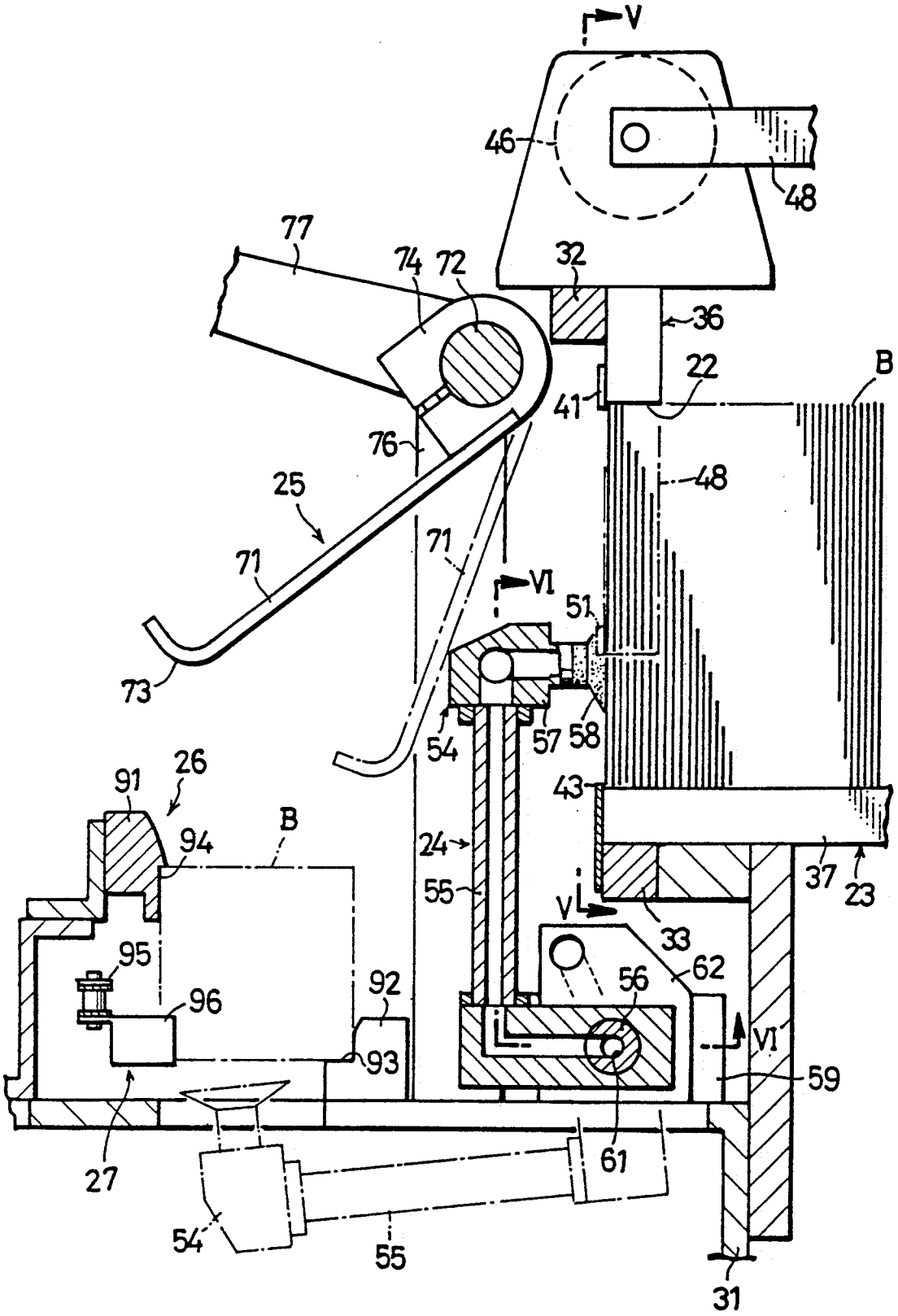
FIG. 4 is a fragmentary enlarged view in section of FIG. 2.
Figure 5:
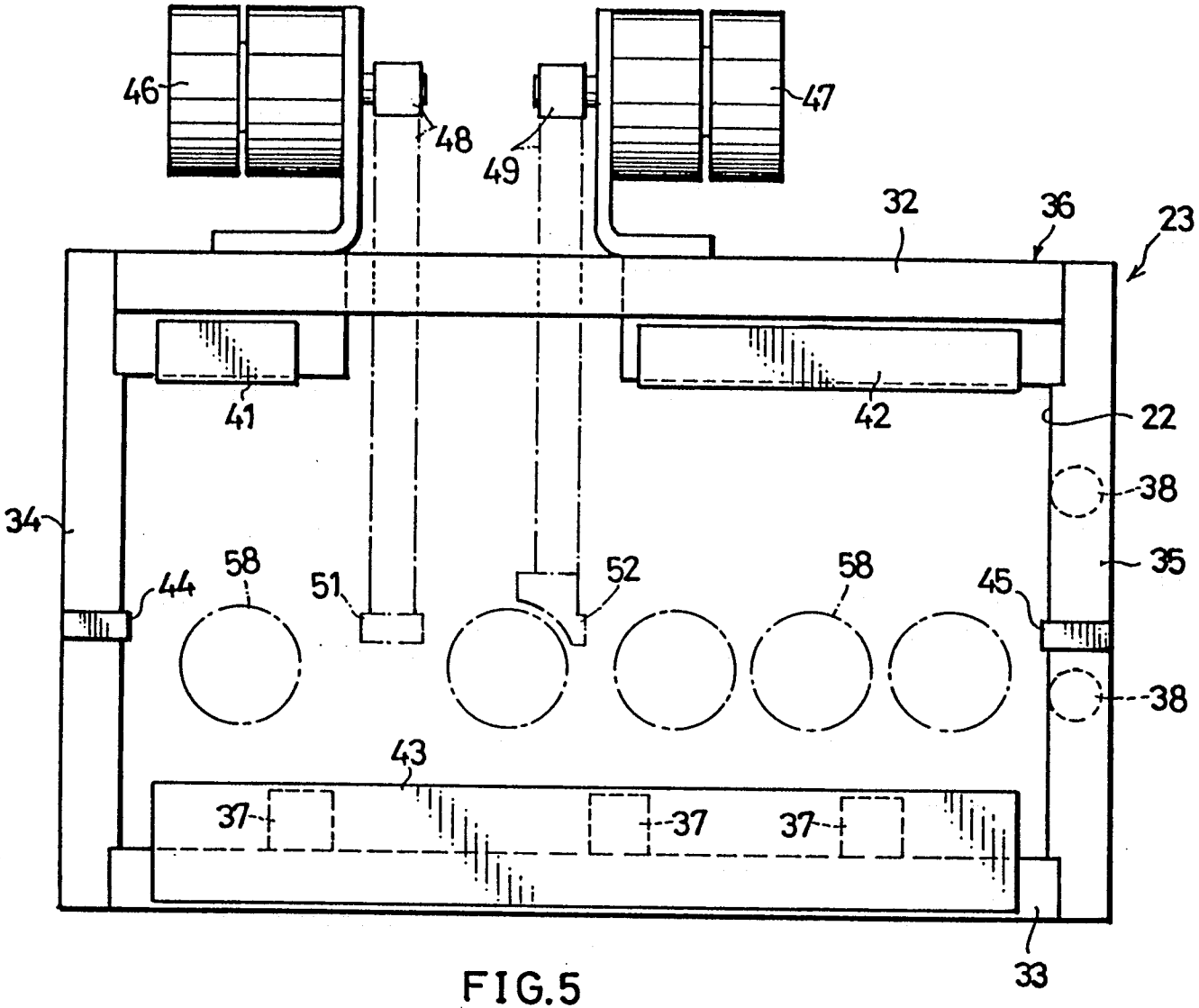
FIG. 5 is a view showing a magazine in detail as it is seen in the direction of arrows V—V in FIG. 4.

With reference to FIGS. 3 to 5, the magazine 23 is mounted on a base 31 which is inclined rearwardly downward at the same angle as the mandrel 21 at rest at the feed station S, with the delivery opening 22 directed leftward. The magazine 23 has a rectangular frame 36 surrounding the delivery opening 22 and comprising upper and lower frame members 32, 33 and front and rear frame members 34, 35, blank edge guide rails 37 extending rightward from the lower frame member 33, and blank end guide rails 38 extending rightward from the rear frame member 35. A multiplicity of blanks B are accommodated in the magazine 23, as arranged side by side closely, with the second side wall panel 12 and the third side wall panel 13 of each blank B directed toward the delivery opening 22 and also with the second panel 12 positioned under the third panel 13. One edge and one end of each blank B are supported by the guide rails 37 and 38, respectively. The upper frame member 32 has a small upper claw 41 and a large upper claw 42 spaced apart therefrom in the rear for opening the blank. The lower frame member 33 is provided with a blank opening lower claw 43 approximately over the entire length thereof. The front and rear frame members 34, 35 have a pair of blank opening front and rear claws 44, 45 respectively, each at an intermediate portion of the height of the member. These claws have their forward ends projected into the delivery opening 22.

Two rotary actuators 46, 47 spaced apart in the front-to-rear direction are mounted on the upper frame member 32 and have their output shafts opposed to each other. The output shafts are respectively provided with arms 48, 49 fixed thereto and carrying movable blank opening front and rear claws 51, 52. One of the movable claws 51, 52 and the front claw 44 is selectively used for handling three kinds of blanks which are different in length. More specifically, neither of the movable claws 51, 52 are used for blanks of maximum length, which are handled by the front claw 44. In place of this claw 44, the movable rear claw 52 is used for blanks of minimum length. Instead of the rear claw 52, the movable front claw 51 is used for blanks of a length intermediate between the maximum and the minimum.

D) Transport Means

The transport means 24 comprises a suction member 54, a pair of transport arms 55 having the suction member 54 attached to their forward ends, and a first rotatable shaft 56 having the base portions of the arms 55 fixed thereto.

The suction member 54 comprises five vacuum cups 58 attached to a support bar 57 of approximately rectangular cross section and arranged side by side longitudinally of the bar. The two transport arms 55 are identical in shape and generally L-shaped. The support bar 57 is connected between and attached to the forward ends of the two transport arms 55. The first rotary shaft 56 is disposed below the delivery opening 22 of the magazine 23, extends at the right side of the holder 26 in parallel to the extension of axis of the mandrel 21 at rest at the feed station S and is supported at two portions close to opposite ends thereof and at an intermediate portion thereof by bearings 59. A rightwardly extending first driven arm 60 is fixed to the rear end of the first shaft 56.

Figure 6:
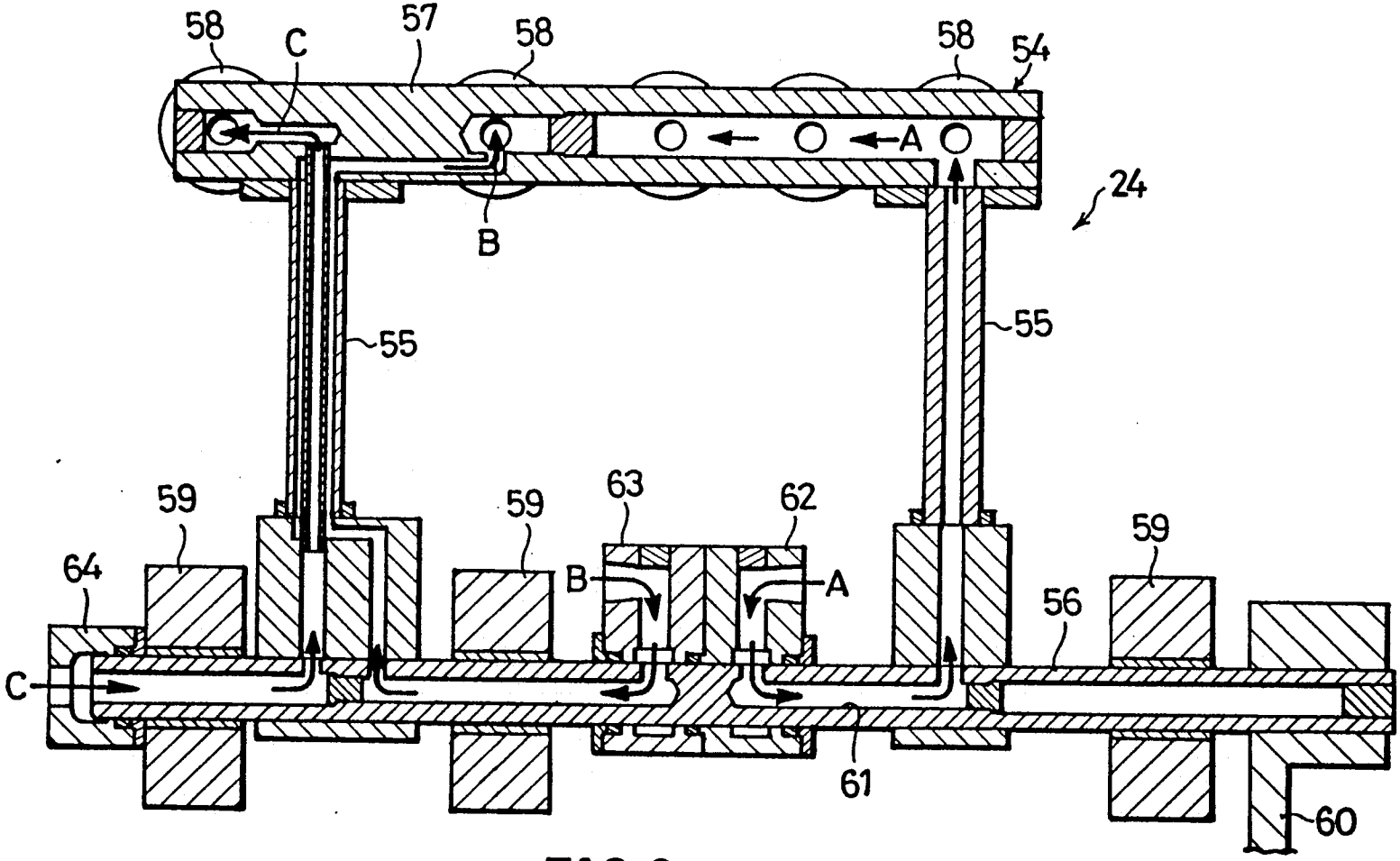
FIG. 6 is a view in section taken along the line VI—VI in FIG. 4 and showing transport means.

With reference to FIG. 6, a channel 61 for supplying working air to the vacuum cups 58 therethrough extends through the support bar 57, two transport arms 55 and first rotatable shaft 56. The air is supplied separately from first and second two supply members 62, 63 mounted on a lengthwise intermediate portion of the first shaft 56 and from a third supply member 64 mounted on the front end of the shaft 56. The air supplied from the three supply members 62 to 64 flows through the channel 61 separately via three routes and is fed to the five vacuum cups 58 as will be described below. With reference to FIG. 6, the air flowing along a first route indicated by arrows A is supplied to the first to third three vacuum cups 58 as counted from the rear. The air flowing through a second route indicated by arrows B is supplied to the fourth cup 58 counted from the rear. The air flowing through a third route indicated by arrows C is supplied to the fifth cup 58 counted from the rear. Thus, air is supplied to the five vacuum cups 58 via the three routes so as to handle three kinds of blanks of varying lengths as already stated for the description of the magazine 23. Stated more specifically, air is supplied through all the first to third routes to use all the five vacuum cups 58 for blanks of maximum length. Air is supplied only via the first route to use the three rear cups 58 for handling blanks of minimum length. Air is supplied via the first and second two routes to use the four cups 58 positioned to the rear for handling blanks of intermediate length between the maximum and the minimum.

E) Unfolding Means

The unfolding means 25 comprises an unfolding arm 71, and a second rotatable shaft 72 having the base portion of the arm 71 fixed thereto.

The unfolding arm 71 has a bent portion 73 at its forward end and, except for the bent portion 73, is in the form of a rectangular flat plate elongated in the front-to-rear direction. The unfolding arm 71 is provided at its upper base portion with two bosses 74 which are spaced apart in this direction and through which the second rotatable shaft 72 extends. The second shaft 72 extends in parallel to the first shaft 56 approximately at the same level as the upper frame member 32 of the magazine 23 in the vicinity thereof and is supported by bearings 75 on a pair of front and rear posts 76. A leftwardly extending second driven arm 77 is fixed to the second shaft 72 between the two bosses 74.

F) Rotating Means

Under the base 1, a drive shaft 81 extends below the first rotatable shaft 56 thereacross. The drive shaft 81 fixedly carries a rearwardly extending first drive arm 82 for the first driven arm 60 and a forwardly extending second drive arm 83 for the second driven arm 77. The first driven arm 60 is connected to the first drive arm 82 by a first connecting rod 84, and the second driven arm 77 to the second drive arm 83 by a second connecting rod 85. The drive shaft 81, when rotated by a cam 97 and a cam follower 98, drives the first and second shafts 56 and 72 in the timed relationship to be described later.

G) Holder

The holder 26 comprises a pair of guide rails 91, 92 extending in parallel to the extension of axis of the mandrel 21 at rest at the feed station S. The two guide rails 91, 92 are arranged on opposite sides of the extension and spaced apart from each other by a distance approximately equal to the length of the diagonal of the tubular blank B. The guide rails 92, 91 are formed with recesses 93, 94, respectively, opposed to each other. These recesses 93, 94 are adapted to receive the corner portion formed by the first panel 11 and the second panel 12 of the tubular blank B and the corner portion formed by the third panel 13 and the fourth panel 14 of the blank, respectively.

H) Transfer Assembly

The transfer assembly 27 comprises an endless chain 95 disposed on one side of the holder 26 opposite to the other side thereof where the magazine 23 is provided, and pushers 96 projecting outward from the chain 95 and equidistantly spaced apart. The pusher 96 comes into contact with the rear end of the blank B as held by the holder 26 and pushes the the blank toward the front, whereby the blank B is transferred from the holder 26 onto the mandrel 21 resting at the feed station S to fit around the mandrel.

I) Unfolding (Fold Forming) Operation

Figure 7:
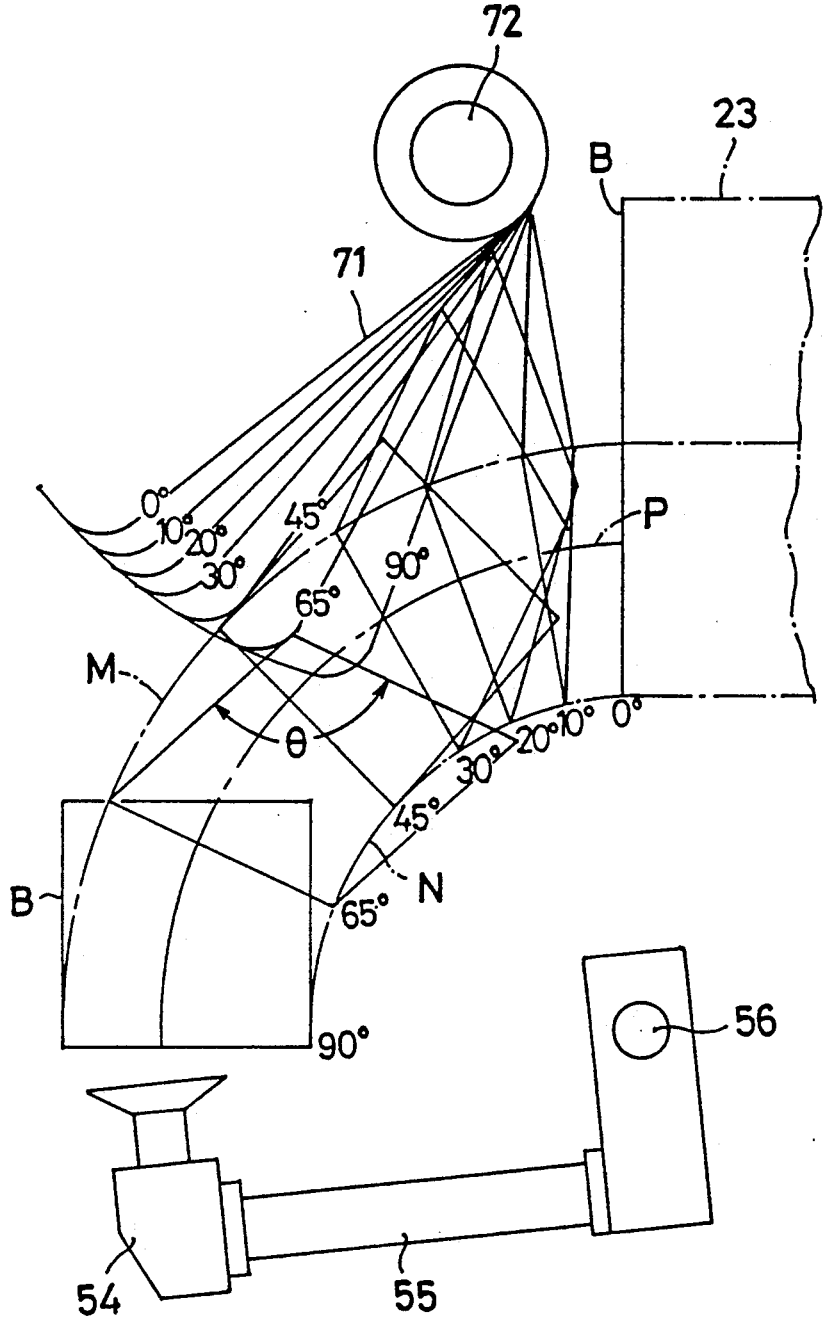
FIGS. 7 to 10 are diagrams illustrating an unfolding operation.
Figure 8:
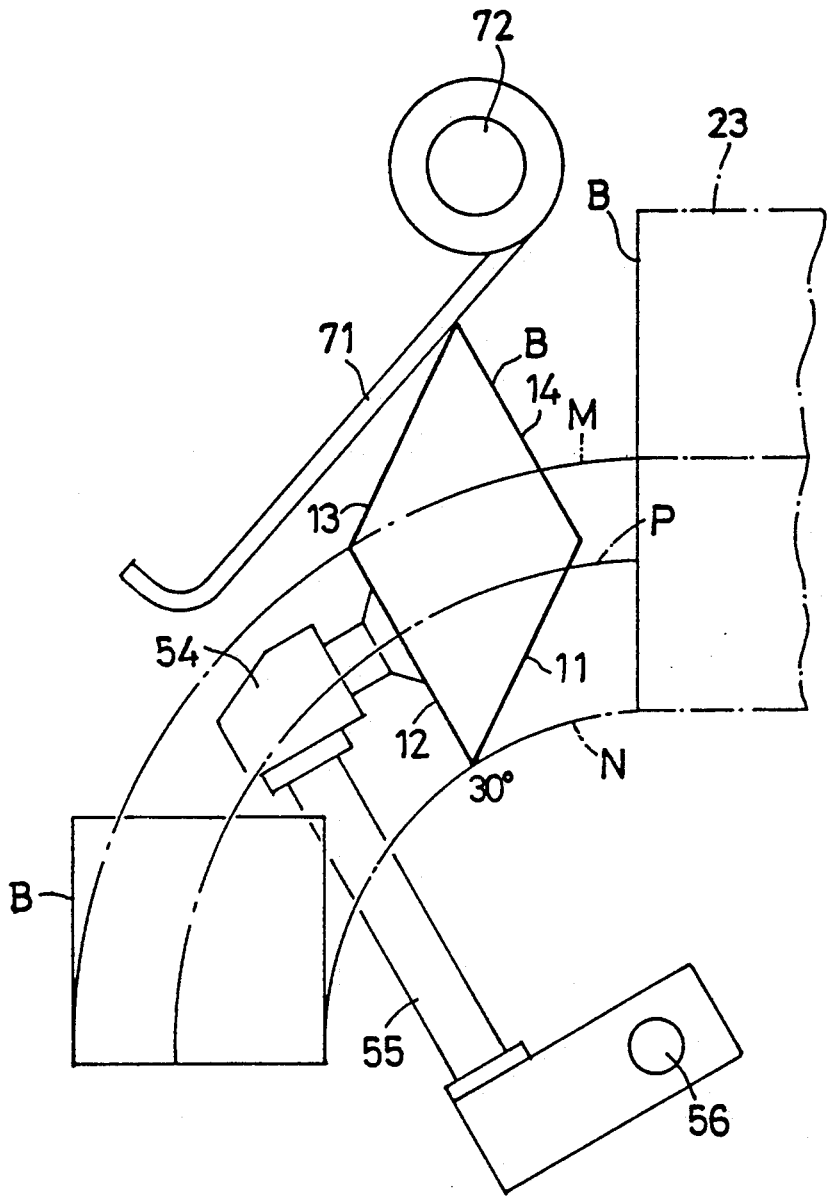
Figure 9:
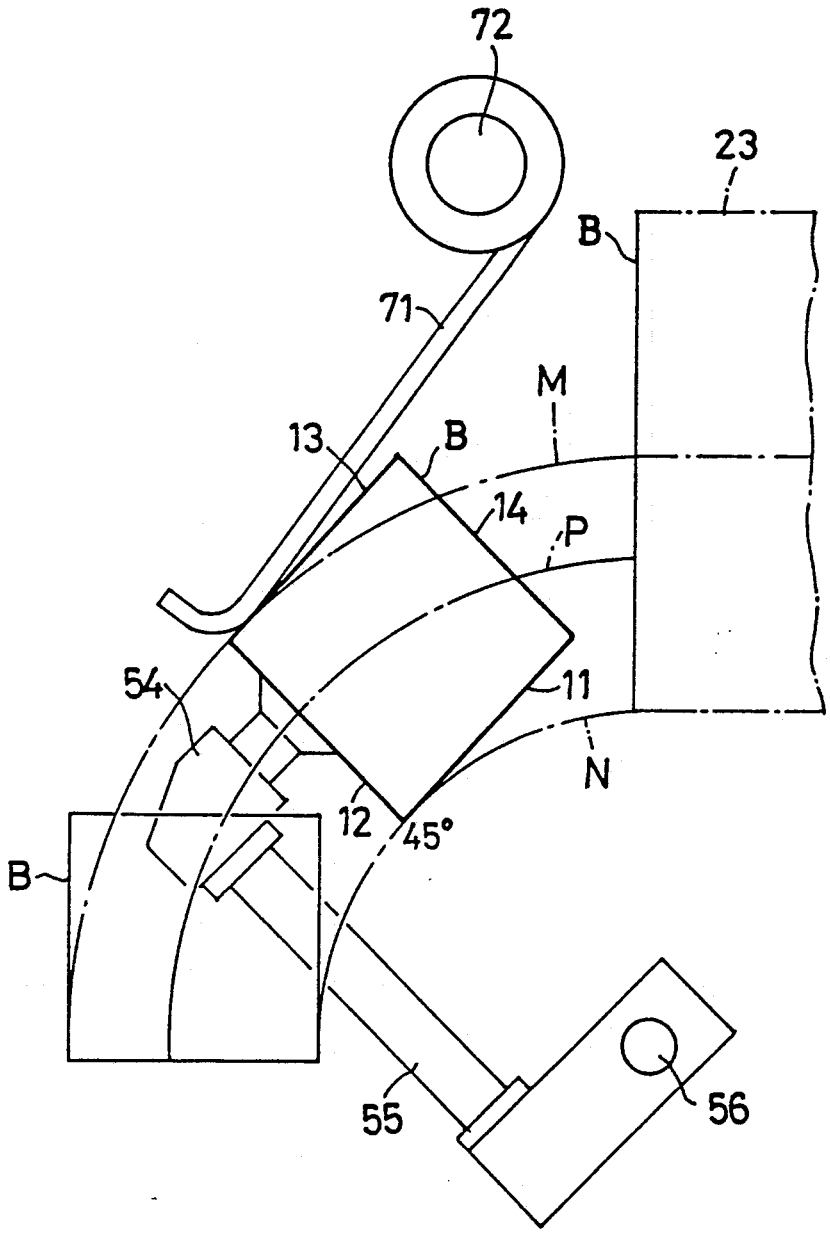
Figure 10:
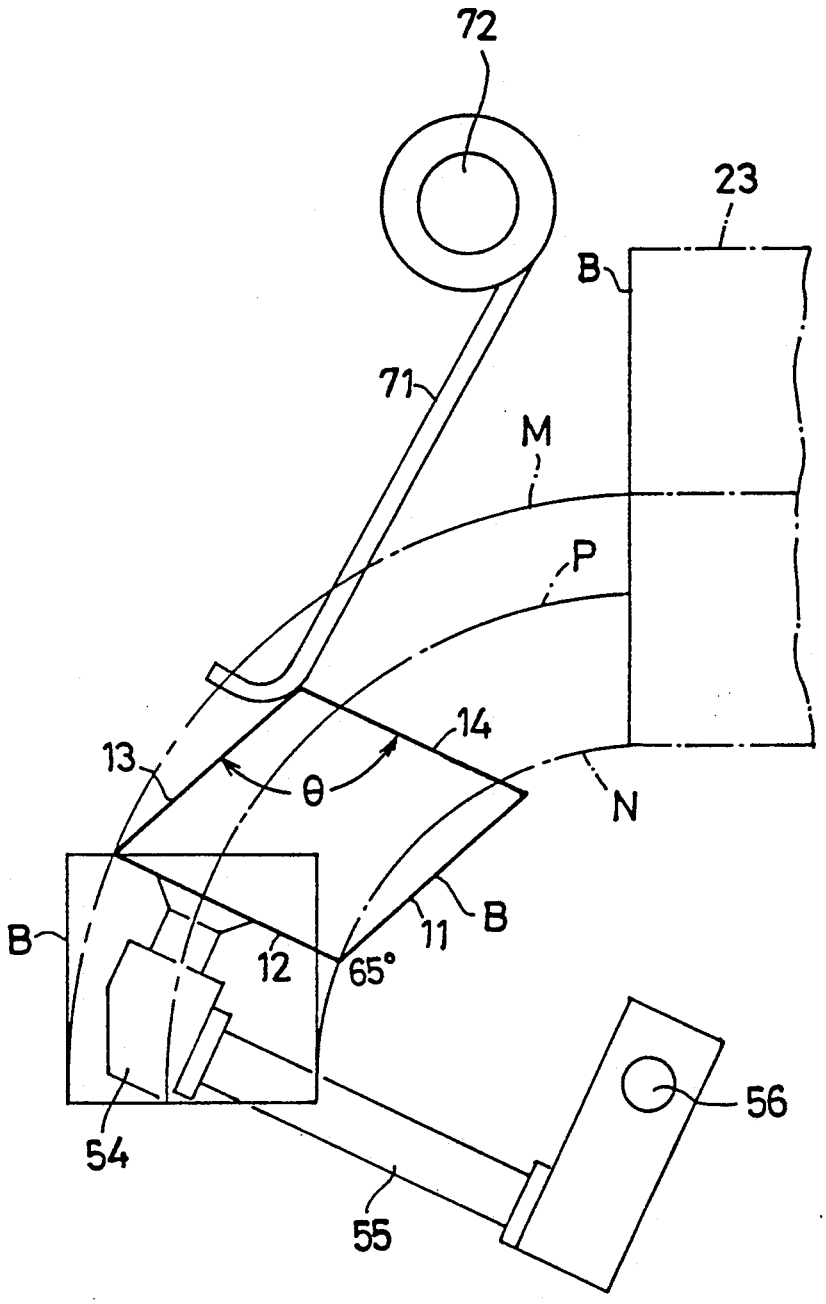

The folded flat blank B is unfolded by the operation to be described below in detail with reference to FIGS. 7 to 10. FIG. 7 schematically shows the magazine 23, first rotatable shaft 56, unfolding arm 71, etc. The angles given in the diagram are based on angles of rotation of the first rotatable shaft 56. The angular position at which the suction member 54 has attracted thereto the second side wall panel 12 of the blank B in the magazine 23 is indicated by 0 degree. The first shaft 56 rotates from this position through an angle slightly greater than 90 degrees. A curve P represents the locus of the center of attraction by the suction member 54. The area defined by curves M and N is the path of movement of the second panel 12 when the panel 12 moves as held attracted to the suction member 54.

When delivered from the magazine 23, the blank B becomes engaged with the blank opening claws 41 to 45 and is thereby slightly unfolded.

Upon the rotation of the first shaft 56 through about 10 degrees, the upper edge of the blank B comes into contact with the unfolding arm 71. Until the unfolding arm 71 is brought into the path of movement of the second side wall panel 12 by the rotation of the first shaft 56 through about 45 degrees, the upper edge of the blank B is depressed by the unfolding arm 71, whereby the blank B is gradually unfolded (see FIG. 8). When advancing into the path of movement of the panel 12, the unfolding arm 71 is in contact with approximately the entire surface of the third side wall panel 13, and the second panel 12 has moved past the lower end of the unfolding arm 71 (see FIG. 9). With the advance of the unfolding arm 71 into the path of movement of the second panel 12, the arm 71 pushes the third panel 13 toward the second panel 12, whereby the blank B is bent along the score 16 between the second panel 12 and the third panel 13 and also along the score 16 between the fourth side wall panel 14 and the first panel 11. Owing to the bending, the angle $\theta$ between the third panel 13 and the fourth panel 14 becomes largest when the first shaft 56 has rotated through about 65 degrees. The largest angle is about 115 degrees (see FIG. 10).

When the first shaft 56 has rotated through 90 degrees, the blank B is released from the suction member 54 and held by the holder 26.

What is claimed is:

1. An apparatus for feeding blanks to a forming mandrel, each of the blanks having first to fourth four side wall panels divided by scores and joined to one another endlessly, the blank being folded to a flat form along the score between the first side wall panel and the second side wall panel and along the score between the third side wall panel and the fourth side wall panel so as to be unfoldable into a tube of rectangular to square cross section, the apparatus being adapted to unfold each blank to the tubular form and feed the tubular blank to the forming mandrel at rest at a feed station, the apparatus comprising:

a magazine having a delivery opening at one end thereof for accommodating a multiplicity of vertical flat blanks as arranged side by side from said one end toward the other end of the magazine, with the second and third side wall panels directed toward the delivery opening and with the second side wall panel positioned under the third side wall panel, the delivery opening being positioned at one side of an extension of the axis of the mandrel obliquely thereabove, transport means for delivering the blanks from the delivery opening one by one and transporting each blank to a position on the extension of axis of the mandrel, the transport means having transport arms and a suction member for holding the second side wall panel of the blank thereto by suction, the suction member being attached to the forward ends of transport arms, the transport arms being fixed at their base ends to a first rotatable shaft from moving said arms disposed below the magazine and extending in parallel to the extension of axis of the mandrel, means for unfolding the blank from the flat form to the tubular form by forming a fold in the opposed flat portions of the blank while the blank is being transported by the transport means, the unfolding means having an unfolding arm, the unfolding arm being fixed at its base portion to a second rotatable shaft for moving said arm extending in parallel to the first rotatable shaft, the second rotatable shaft being disposed on opposite side to the first rotatable shaft with respect to the path of movement of the second side wall panel of the blank held to the suction member so as to render the forward end of the unfolding arm movable into and out of the path of movement, a holder for holding the tubular blank on the extension of axis of the mandrel in alignment therewith movably along the extension, and a transfer assembly for transferring the blank from the holder to the mandrel.

2. An apparatus as defined in claim 1 wherein the magazine has a frame member surrounding the delivery opening and a plurality of blank opening claws provided on required portions of the frame member and having their forward ends projected into the delivery opening.

3. An apparatus as defined in claim 1 wherein the unfolding arm is in the form of a plate generally J-shaped in cross section and having a bent portion at its forward end.

4. An apparatus as defined in claim 1 which further comprises means for rotating the first rotatable shaft and the second rotatable shaft in synchronism so that after the second side wall panel held to the suction member has moved past the forward end of the unfolding arm approaching said path of movement, the forward end of the unfolding arm advances into said path to push the third side wall panel toward the second side wall panel and thereby bend the blank along the score between the second side wall panel and the third side wall panel until the angle between the third side wall panel and the fourth side wall panel increases to at least 90 degrees.

5. An apparatus as defined in claim 4 wherein the rotating means includes a drive shaft having connected thereto the first rotatable shaft and the second rotatable shaft each through a power transmission mechanism.

6. An apparatus as defined in claim 1 wherein the holder comprises a pair of guide rails extending on opposite sides of the extension of axis of the mandrel in parallel thereto, and the pair of guide rails are formed with a pair of opposed recesses respectively for receiving the corner portion formed by the first side wall panel and the second side wall panel of the tubular blank and the corner formed by the third side wall panel and the fourth side wall panel thereof.

* * * * *